US006990311B2

(12) United States Patent
Pyle et al.

(10) Patent No.: US 6,990,311 B2
(45) Date of Patent: Jan. 24, 2006

(54) APPARATUS AND METHOD FOR LIMITING MEDIA MOVEMENT ON AN IMAGING APPARATUS

(75) Inventors: Norman Conrad Pyle, Greeley, CO (US); Randall Jay Briggs, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 156 days.

(21) Appl. No.: 10/397,560

(22) Filed: Mar. 26, 2003

(65) Prior Publication Data

US 2004/0190961 A1 Sep. 30, 2004

(51) Int. Cl.
*G03G 15/00* (2006.01)

(52) U.S. Cl. ..... 399/380; 399/372; 399/377; 355/75

(58) Field of Classification Search ..... 355/75; 399/2, 3, 7, 372, 377, 380
See application file for complete search history.

(56) References Cited

U.S. PATENT DOCUMENTS

| | | | | |
|---|---|---|---|---|
| 4,831,420 A | | 5/1989 | Walsh et al. | |
| 5,072,923 A | | 12/1991 | Coy | |
| 5,126,787 A | * | 6/1992 | Irie et al. | 355/75 |
| 5,162,926 A | * | 11/1992 | Yeadon et al. | 358/492 |
| 5,483,325 A | * | 1/1996 | Bodapati et al. | 399/377 |
| 5,574,542 A | * | 11/1996 | Brook, III | 399/380 |
| 5,595,004 A | * | 1/1997 | Lyden et al. | 36/29 |
| 5,666,617 A | | 9/1997 | Goodman et al. | |
| 5,790,915 A | | 8/1998 | Arcaro et al. | |
| 5,798,825 A | | 8/1998 | Blanding et al. | |
| 5,828,469 A | | 10/1998 | Kowalski et al. | |
| 6,233,426 B1 | * | 5/2001 | Lee et al. | 399/380 |
| 6,254,090 B1 | | 7/2001 | Rhodes et al. | |
| 6,408,162 B1 | | 6/2002 | Sheng et al. | |
| 6,542,224 B2 | * | 4/2003 | Ackerman et al. | 355/72 |
| 6,640,083 B2 | * | 10/2003 | Conard-White et al. | 399/377 |
| 2003/0067634 A1 | | 4/2003 | Payne et al. | |

FOREIGN PATENT DOCUMENTS

| | | |
|---|---|---|
| EP | 1 260 876 | 11/2002 |
| JP | 62055637 | 3/1987 |
| JP | 5053214 | 3/1993 |
| JP | 7230129 | 8/1995 |
| JP | 2000275752 | 10/2000 |

OTHER PUBLICATIONS

Foreign Search Report issued for GB 0406629.6, dated Aug. 5, 2004.

* cited by examiner

*Primary Examiner*—Ren Yan
*Assistant Examiner*—Dave A. Ghatt

(57) ABSTRACT

Disclosed are systems and methods for limiting movement of medium on an imaging apparatus comprising positioning the medium against an imaging surface, moving a moveable surface to sandwich the medium between the imaging surface and the moveable surface, and passing air through at least one opening disposed to reduce forces acting on the medium that are caused by air currents generated adjacent the imaging surface when the moveable surface is moved.

32 Claims, 3 Drawing Sheets

APPARATUS AND METHOD FOR LIMITING MEDIA MOVEMENT ON AN IMAGING APPARATUS

FIELD OF INVENTION

The present invention generally relates to imaging of media, and more particularly to limiting media movement on an imaging apparatuses.

DESCRIPTION OF RELATED ART

A basic format for different types of devices that capture images on a sheet of paper or other media include an imaging surface (referred to herein as a "platen"), e.g., a surface of a glass plate or a PLEXIGLAS® plate or a plate of other composition, adjacent which a medium, e.g., sheet of paper or other object, can be manually positioned for image processing. Such devices, which include copiers, scanners, facsimile machines, printers, and other document imaging apparatuses, often include a hinged lid or other movable surface adapted to come into contact with at least a portion of the medium placed adjacent the platen. The lid may be moved away from the platen (opened) to facilitate positioning media adjacent the platen, and the hinged lid also may be moved against media positioned adjacent the platen (closed) to maintain media in fixed positions during image scanning. However, when the lid or other movable surface is opened or closed adjacent an imaging surface resultant variations in ambient air pressure are brought about by the lid movement in the space adjacent the imaging surface. If a sheet of paper or other light-weight medium has been placed adjacent the platen, the induced ambient air pressure variations including partial vacuums that are caused by air pressure currents may result in the medium being moved from a desired position or even away from the platen.

In the instance of moving a lid toward a previously-positioned medium, the produced variations in ambient air pressure may cause the medium to move so that resultant processed images are skewed or not centered at an operator-selected position. Because scanned images are now predominately digitized, software has been written to adjust scanned images for reproduction by rotation to correct for angular misalignments of media being scanned. Utilization of such software, however, increases cost and time for image processing and also system complexity.

When an imaging apparatus lid is opened, a medium previously positioned adjacent the platen may be moved away from the platen by induced ambient air pressure variations that can include creation of a partial vacuum about the medium. If, as a result of the lid being opened, the medium is thereby caused to be moved away from the platen and adjacent the moving lid, the medium can be moved sufficiently far from the platen to have it fall off the imaging apparatus. Old or otherwise delicate documents, for example, can be damaged by so falling off an imaging apparatus.

Clip type retainers have been attached to lid surfaces to preclude media from falling off imaging devices. An operator first would use the clip to attach a medium to be imaged to the lid. Then the operator would move the lid with the attached medium to be adjacent an imaging surface. When the lid with the attached medium is opened, the medium could be removed from the lid by releasing the clip from the medium. All of these operations, including being sure that the clipped medium is moved by the lid onto a correct position on an imaging surface, increase the time and effort required of an operator in scanning an image. Other unavoidable problems associated with using clips attached to imaging apparatuses—whether to lids or adjacent platens—are that clips, which must be flexed to attach or release media, will wear out and even break. Moreover, the use of such clips can obscure portions of the image to be processed.

Lips or other protrusions on or adjacent imaging surfaces have been used to attempt to hold media in a desired position. However, such lips or protrusions typically do not restrict movement of a medium in all directions and, therefore, do not fully address the aforementioned media movement issues. Moreover, although often being somewhat effective in preventing a medium from falling off of an imaging surface, such lips or protrusions can result in damage to the media when forced against the surfaces of the lip or protrusion.

A familiar technique operators have used so as to avoid having previously positioned media moved about or lifted away from imaging surfaces when lids are opened or closed is to reduce the speed at which lids are moved. Understandably, this approach increases the time required for scanning images, and usually, the media still shifts.

BRIEF SUMMARY OF THE INVENTION

Embodiments provide a system for limiting medium movement on an imaging apparatus, the system comprising an imaging surface and a moveable surface disposed to be moved to sandwich the medium between the imaging surface and the moveable surface, and at least one air passage opening disposed to pass air through the moveable surface.

Embodiments provide a system for limiting medium movement on an imaging apparatus, the system comprising an imaging surface, a moveable surface capable of being moved to sandwich the medium between the imaging surface and the moveable surface, and at least one air passage opening disposed adjacent the imaging surface to pass air away from the imaging surface when the moveable surface is moved.

Embodiments provide a method for limiting movement of a medium on an imaging apparatus comprising positioning the medium against an imaging surface, moving a moveable surface to sandwich the medium between the imaging surface and the moveable surface, and passing air through at least one opening disposed to reduce forces acting on the medium that are caused by air currents generated adjacent the imaging surface when the moveable surface is moved.

DETAILED DESCRIPTION

Figure 1A:
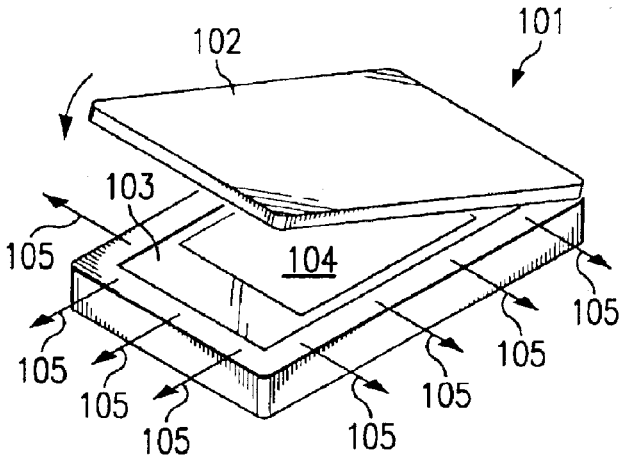
FIG. 1A (PRIOR ART)
FIG. 1A is a perspective view of a prior art scanner with a lid partially closed.
Figure 1B:
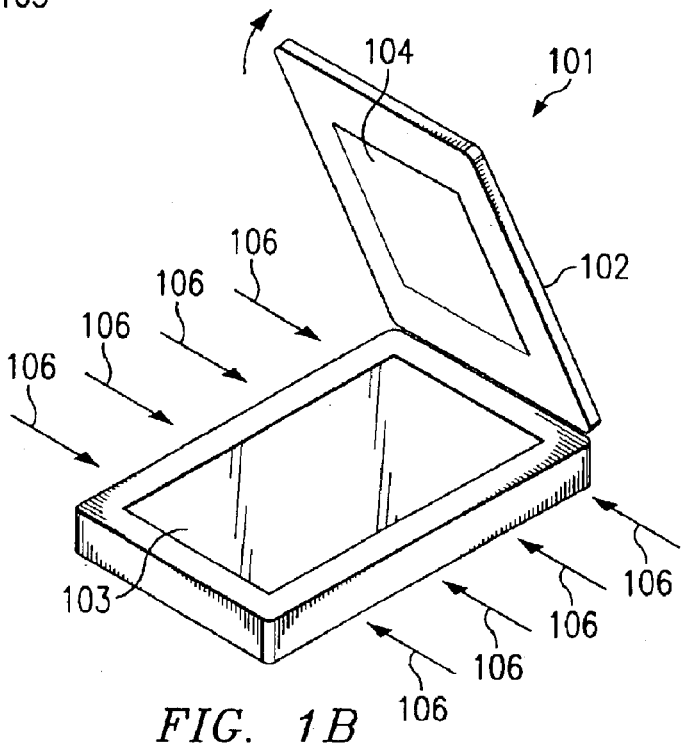
FIG. 1B (PRIOR ART)
FIG. 1B is a perspective view of the prior art scanner of FIG. 1A with the lid fully open and off an imaging surface.

Referring to FIGS. 1A and 1B, an exemplary prior art scanner 101 is shown. The present invention is described here generally with reference to scanners that digitize scanned images from media such as documents, including sheets of paper, objects, etcetera. The present invention is not limited to use with scanners but instead is readily implementable with other image processing apparatuses without limitation, such as copiers, facsimile machines, printers, etc.

Scanner 101, as shown in FIG. 1A, includes hinged lid 102 in the process of being brought down onto platen 103 on which medium 104 to be scanned has been positioned. This movement of lid 102 produces movement of air away from platen 103 as is represented by arrows 105. Such air movements 105 are forces that can cause movement or repositioning of medium 104 with respect to platen 103, or even result in displacement of medium 104 off of platen 103. In contrast, as shown in FIG. 1B, when lid 102 is being raised away from platen 103 movements of air back into spaces adjacent platen 103 are produced as shown by arrows 106. Concomitant with air movements into spaces adjacent platen 103 that are produced by raising lid 102 is an initial reduced ambient air pressure, i.e., partial vacuum, adjacent lid 102 surface that was previously lowered onto platen 103. Moving lid 102 induces forces, i.e., partial vacuums, that can move medium 104 adjacent platen 103 and/or lift medium 104 off of platen 103 and thereby temporarily "attach" medium 104 to lid 102.

Movements of medium 104 are caused by air movements 105 and 106 which are stochastic. Accordingly, an operator placing medium 104 on platen 103 can not predict the amount and directions of medium 104 movements that could be caused by moving lid 102, or be informed as to how slowly lid 102 needs to be moved to prevent medium 104 from being moved by air movements 105 or 106.

The present invention overcomes these problems that can be caused by lowering and raising lid 102 with respect to a medium 104 positioned on platen 103.

Figure 2:
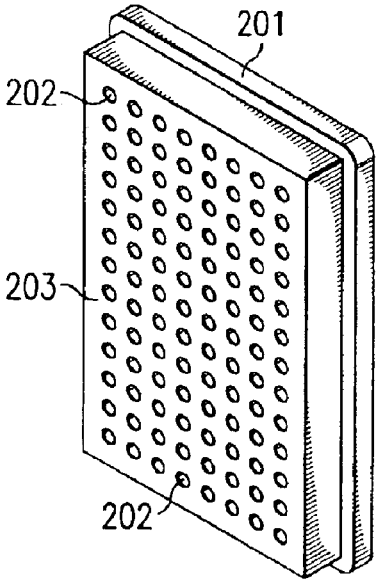
FIG. 2 is a perspective view of an embodiment of a lid with pad and passages according to the present invention.

FIG. 2 illustrates a perspective view of lid 201 incorporating one embodiment of the present invention. Specifically, lid 201 includes openings 202 to permit air that otherwise would be compressed by movement of lid 201 to pass through lid 201 and to thereby substantially not be displaced by lid 201 movements. Conversely, openings 202 in providing for passage of air through lid 201 also mitigate ambient air pressures from being reduced by movements of lid 201.

As shown in FIG. 2, lid 201 includes pad 203, which when lid 201 is brought toward platen 103 provides a cushion to rest against medium 104 that is positioned adjacent platen 103. Pad 203 of embodiments of the invention may comprise a resilient or compressible material, such as may be formed from a foamed material. Openings 202 for the embodiment shown in FIG. 2 are preferably continuous through both pad 203 and lid 201 to enable air to move through lid 201 and thereby minimize air pressure fluctuations induced by motion of lid 201.

Figure 3:
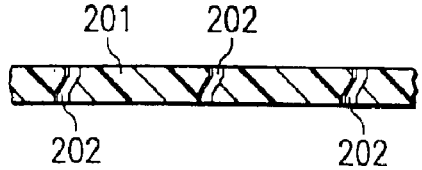
FIG. 3 is a partial sectional view of a lid of one embodiment of the present invention showing passages with turns to attenuate light from passing through the lid.

Referring to FIG. 3, openings 202 in lid 201 are shown to incorporate turns and to be continuous. The continuity of openings 202 provides for air to move through lid 201. By incorporating turns, or other adaptations, such as baffles, in openings 202 the transmission of light through openings 202 and onto platen 103 is attenuated. This attenuation of light transmission promotes provision of platen 103 with an uniform background environment for effective imaging.

Figure 4A:
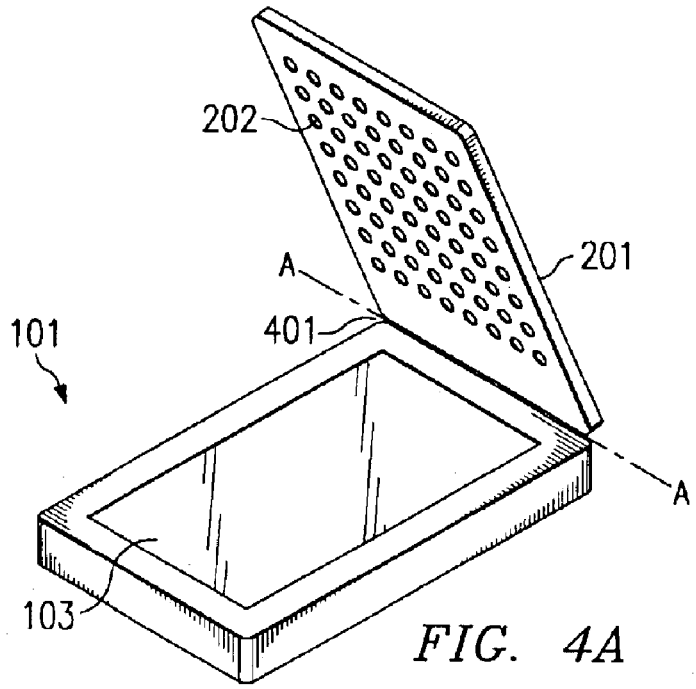
FIG. 4A is a perspective view of a scanner with a hinged lid having an arrangement of passages in accordance with an embodiment of the invention.
Figure 4B:
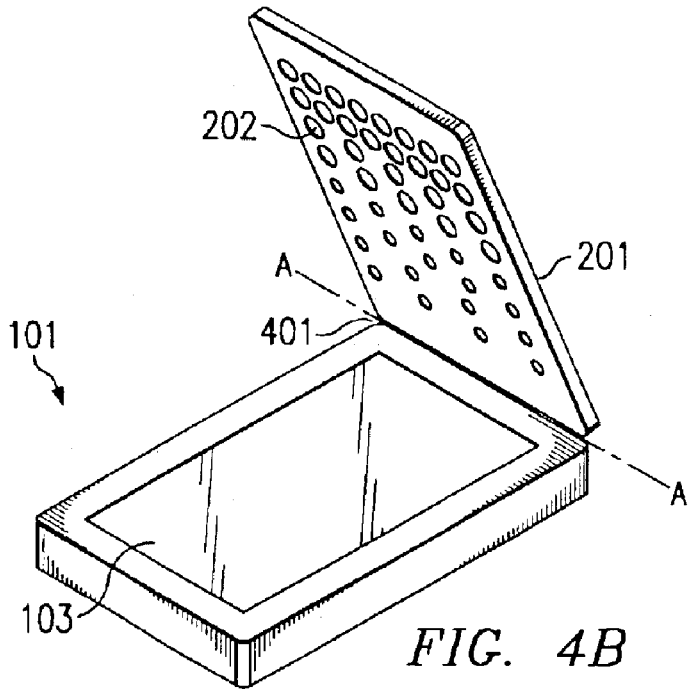
FIG. 4B is a perspective view of a scanner with a hinged lid having an arrangement of passages in accordance with another embodiment of the invention.

Referring to FIG. 4A, scanner 101 can include hinge 401 for attachment of lid 201. As such, hinge 401 establishes axis A—A about which lid 201 can be rotated toward and away from platen 103. It will be appreciated that rotational movement of lid 201 toward and away from platen 103 results in less air being moved by lid 201 as the distance along lid 201 away from axis A—A decreases, whereas an increased volume of air is encountered and can be moved by lid 201 as the distance along lid 201 away from axis A—A increases. To address this situation one embodiment of the present invention includes increased numbers of or sizes for openings 202, or both, as distances along lid 201 away from axis A—A increase. Such increase(s) for openings 202 (as shown in FIG. 4B) provide for channeling more air through lid 201 as distances along lid 201 away from axis A—A increase.

Figure 5:
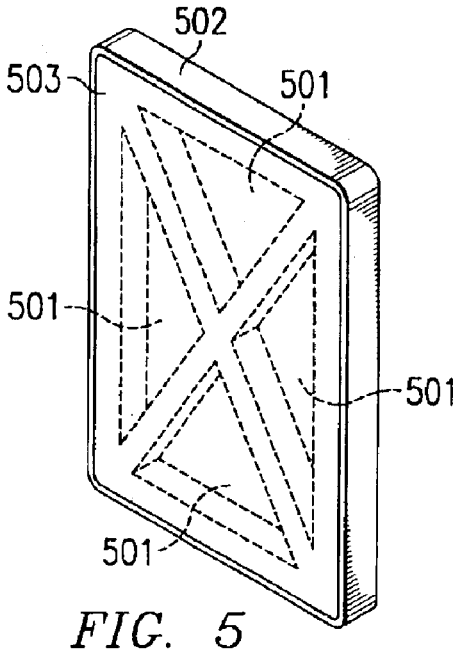
FIG. 5 is a perspective view of an embodiment of an imaging apparatus lid with a fabric covering having an open grid shown in phantom and openings through the fabric shown in a partial exploded view.

Referring to FIG. 5, where another embodiment for the present invention is shown, large volume open grid patterns 501 are provided through lid 502. For this embodiment, openings in lid 502 are provided by a combination of open grid patterns 501 and openings 503 in fabric 504 covering open grid patterns 501. Openings 503 in fabric 504 can be holes through fabric 504, or can be provided by spacings between threads woven to form fabric 504, or can be provided by both holes and spacings between woven threads.

Figure 6:
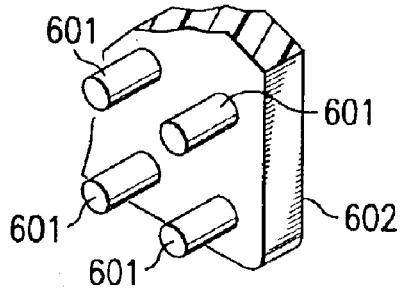
FIG. 6 is a partial perspective view of an imaging apparatus lid with extending projections according to an embodiment of the invention.

Referring to FIG. 6, an embodiment for the present invention is shown having projections 601 extending from lid 602. When lid 602 with projections 601 is lowered onto platen 103, air passes between projections 601. Medium 104 is pressed by projections 601 against platen 103 as lid 602 is closed with respect to platen 103. Alternatively, when lid 602 is moved away from platen 103, air again is passed between projections 601 to attenuate air pressure variations about medium 104. A combination of both projections 601 and openings 202 through lid 602 can be used to attenuate air pressure variations.

Figure 7:
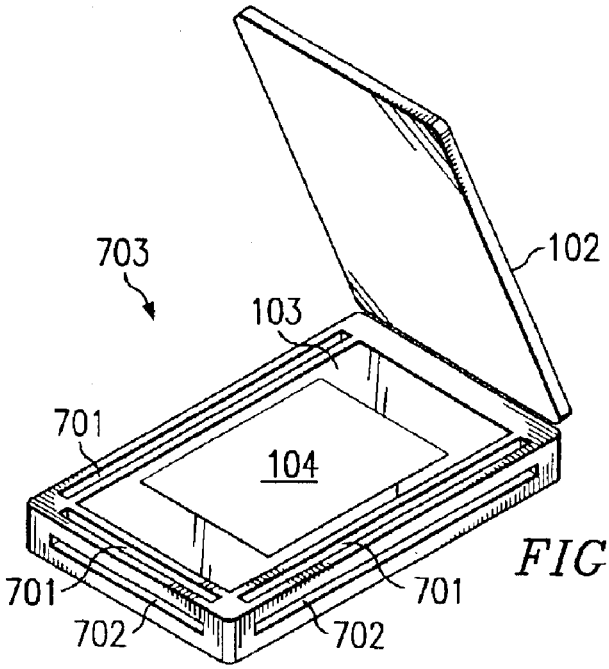
FIG. 7 is a perspective view of a scanner with passages provided adjacent an imaging surface according to another embodiment of the invention.

Referring to FIG. 7, another embodiment for the present invention provides openings 701 in housing 705 adjacent platen 103. Here openings 701 incorporate turns so air currents produced by lid 102 movements are passed from adjacent platen 103 to distanced side openings 702 on scanner 703. For instance closing lid 102 toward medium 104 positioned against platen 103 results in air being passed through openings 701 and 702 as shown by air movements 706. Openings 202, as shown in FIGS. 2, 4A, 4B and 6, including openings 501 and 503, as shown in FIG. 5, and also projections 601, as shown in FIG. 6, can be combined separately or in combinations with openings 701 of this embodiment.

What is claimed is:

1. A system for limiting medium movement on an imaging apparatus, the system comprising:

an imaging surface;

a moveable surface disposed to be moved to sandwich the medium between the imaging surface and the moveable surface, and at least one air passage opening disposed to pass air through the moveable surface; and a compressible pad disposed upon the moveable surface so that when the moveable surface is moved to sandwich the medium adjacent the imaging surface, the pad is between the moveable surface and the medium, wherein the pad comprises at least one air passage opening formed to correspond to the at least one air passage opening through the moveable surface to pass air through both the pad and the moveable surface.

2. The system of claim 1 further comprising an axis about which the moveable surface can be rotated.

3. The system of claim 2 wherein more than one air passage opening is disposed through the moveable surface, and the air passage openings are disposed about the moveable surface to provide for increased volumes of air to be passed through the moveable surface at distances along the moveable surface from the axis over volumes of air passed through the moveable surface at distances along the moveable surface closer to the axis.

4. The system of claim 1 wherein there is at least one air passage opening provided between projections extending from the moveable surface to pass air away from the moveable surface.

5. The system of claim 4 wherein the projections are cylindrical.

6. The system of claim 1 wherein the imaging apparatus is selected from the group consisting of scanners, copiers, facsimile machines and printers.

7. The system of claim 1 wherein the at least one air passage opening is provided by at least one opening in a fabric disposed on the moveable surface.

8. The system of claim 1 wherein the at least one air passage opening includes at least one turn to attenuate light from being passed through the moveable surface onto the imaging surface.

9. A system of claim 1, wherein the at least one air passage opening has at least one turn.

10. A method for limiting movement of a medium on an imaging apparatus, the method comprising:

positioning the medium against an imaging surface;

moving a moveable surface to sandwich the medium between the imaging surface and the moveable surface; and passing air through at least one opening disposed to reduce forces acting on the medium that are caused by air currents generated adjacent the imaging surface when the moveable surface is moved, wherein the at least one opening comprises a plurality of openings disposed through a fabric disposed over a larger opening through the moveable surface.

11. The method of claim 10 wherein more than one opening is disposed through the moveable surface so as to provide for passage of increased volumes of air to be passed through the moveable surface at distances along the moveable surface from an axis about which the moveable surface is rotatably moved over volumes of air passed through the moveable surface at distances along the moveable surface closer to the axis.

12. The method of claim 10 wherein the at least one opening is provided between projections extending from the moveable surface.

13. The method of claim 12 wherein at least one opening is disposed through said moveable surface.

14. The method of claim 12 wherein at least one opening is disposed adjacent the imaging surface.

15. The method of claim 10 wherein the at least one opening to pass air includes at least one turn.

16. The method of claim 10 wherein the at least one opening includes an opening that is disposed adjacent the imaging surface.

17. A system for limiting medium movement on an imaging apparatus, the system comprising:

a moveable surface means for movement to sandwich the medium between an image scanning surface and the moveable surface means; and at least one air passage opening means for passing air when the moveable surface means is moved, wherein more than one air passage opening means are disposed through the moveable surface means, and the air passage opening means are disposed in the moveable surface means for passing increased volumes of air through the moveable surface means at distances along the moveable surface from an axis about which the movable surface means is rotated over volumes of air passed through the moveable surface means at distances along the moveable surface means closer to the axis.

18. The system of claim 17 wherein the at least one air passage opening means includes at least one turn means for attenuating light from being passed through the moveable surface onto the imaging surface.

19. A system for limiting medium movement on an imaging apparatus, the system comprising:

an imaging surface;

a moveable surface disposed to be moved to sandwich the medium between the imaging surface and the moveable surface, and at least one air passage opening provided between cylindrical projections extending from the moveable surface to pass air away from the moveable surface.

20. The system of claim 19 wherein said movable surface has at least one air passage opening disposed to pass air through the movable surface.

21. The system of claim 19 wherein the imaging apparatus is selected from the group consisting of scanners, copiers, facsimile machines and printers.

22. A system for limiting medium movement on an imaging apparatus, the system comprising:

an imaging surface;

a moveable surface disposed to be moved to sandwich the medium between the imaging surface and the moveable surface, and at least one air passage opening disposed to pass air through the moveable surface, wherein the at least one air passage opening is provided by at least one opening in a fabric disposed on the moveable surface.

23. The system of claim 22 wherein the imaging apparatus is selected from the group consisting of scanners, copiers, facsimile machines and printers.

24. The system of claim 22 wherein said at least one opening in said fabric is disposed over a larger opening through the moveable surface.

25. A system for limiting medium movement on an imaging apparatus, the system comprising:

a movable surface disposed to be moved to sandwich the medium between an imaging surface and the movable surface, the movable surface having at least one air passage opening having a predetermined size and shape disposed to pass air through the movable surface; and a compressible pad disposed upon the moveable surface so that when the movable surface is moved to sandwich the medium when adjacent the imaging surface the pad is between the movable surface and the medium, wherein the pad includes at least one air passage formed therein having a size and shape corresponding to said predetermined size and shape to pass air through both the pad and the movable surface.

26. The system of claim 25 wherein the at least one air passage formed in the pad is disposed to correspond to the at least one air passage opening through the movable surface.

27. The system of claim 25 wherein said at least one air passage formed in the pad includes a turn to discourage light from being passed through the movable surface to the imaging surface.

28. A method for limiting movement of a medium on an imaging apparatus, the method comprising:

moving a moveable surface to sandwich the medium between an imaging surface and the movable surface; and passing air through a fabric disposed over at least one opening positioned to reduce forces acting on the medium that are caused by air currents generated when the movable surface is moved.

29. The method of claim, 28 wherein said passing further comprises passing air through a plurality of openings disposed through said fabric.

30. The method of claim 28 wherein said passing further comprises passing air through the fabric disposed over a larger opening through the moveable surface.

31. A system for limiting medium movement on an imaging apparatus, the system comprising:

a moveable surface disposed to be moved to sandwich the medium between an imaging surface and the movable surface, and at least one air passage opening disposed to pass air through a fabric disposed on the movable surface.

32. The system of claim 31 wherein at least one opening in the fabric is disposed to cooperate with said at least one air passage opening to pass air through the fabric when the movable surface is moved.

* * * * *

UNITED STATES PATENT AND TRADEMARK OFFICE

CERTIFICATE OF CORRECTION

PATENT NO. : 6,990,311 B2
APPLICATION NO. : 10/397560
DATED : January 24, 2006
INVENTOR(S) : Norman Conrad Pyle et al.

It is certified that error appears in the above-identified patent and that said Letters Patent is hereby corrected as shown below:

In column 8, line 1, in Claim 29, delete “claim,” and insert -- claim --, therefor.

Signed and Sealed this

Nineteenth Day of May, 2009

John Doll

JOHN DOLL
*Acting Director of the United States Patent and Trademark Office*